US011400699B2

(12) United States Patent
Yamamoto

(10) Patent No.: US 11,400,699 B2
(45) Date of Patent: Aug. 2, 2022

(54) LAYER TRANSFERRING DEVICE INCLUDING HEAT ROLLER PROVIDED IN MAIN CASING AND MOVABLE RELATIVE TO PRESSURE ROLLER PROVIDED AT COVER

(71) Applicant: BROIHER KOGYO KABUSHIKI KAISHA, Nagoya (JP)

(72) Inventor: Tomoya Yamamoto, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/443,592

(22) Filed: Jul. 27, 2021

(65) Prior Publication Data

US 2021/0370664 A1 Dec. 2, 2021

Related U.S. Application Data

(63) Continuation of application No. PCT/JP2019/020633, filed on May 24, 2019.

(30) Foreign Application Priority Data

Jan. 30, 2019 (JP) ..... JP2019-014626

(51) Int. Cl.
*B41F 16/00* (2006.01)
*B41F 13/008* (2006.01)
*B41J 2/325* (2006.01)

(52) U.S. Cl.
CPC ..... *B41F 16/0026* (2013.01); *B41F 13/008* (2013.01); *B41J 2/325* (2013.01)

(58) Field of Classification Search
CPC ..... B41F 13/008; B41F 16/0026; B41J 2/325
See application file for complete search history.

(56) References Cited

U.S. PATENT DOCUMENTS 4,663,638 A * 5/1987 Hirose ..... B41J 15/042 346/24
6,109,472 A * 8/2000 Gibier ..... G07B 1/00 221/33

(Continued)

FOREIGN PATENT DOCUMENTS

JP 1-163789 A 6/1989
JP 2001-289287 A 10/2001

(Continued)

OTHER PUBLICATIONS

International Search Report and Written Opinion issued in corresponding International Patent Application No. PCT/JP2019/020633, dated Aug. 6, 2019.

(Continued)

*Primary Examiner* — David H Banh
(74) *Attorney, Agent, or Firm* — Merchant & Gould P.C.

(57) ABSTRACT

A layer transferring device includes: a main casing having an opening and accommodating a heat roller, a motor, and a first transmission gear therein; a film cartridge; and a cover at which a pressure roller and a second transmission gear is provided and movable about a pivot axis to open and close the opening. The heat roller is movable toward and away from the pressure roller when the cover is closed. When the film cartridge is attached to the main casing and the cover is closed, the multilayer film contacts and passes through between the pressure roller and the heat roller. When the cover is closed, the first transmission gear for receiving a driving force from the motor and the second transmission gear for transmitting a driving force to the pressure roller are positioned between the pivot axis and the heat roller and in meshing engagement with each other.

10 Claims, 10 Drawing Sheets

(56) References Cited

U.S. PATENT DOCUMENTS

| | | | | |
|---|---|---|---|---|
| 2003/0174195 | A1* | 9/2003 | Onishi | B41J 3/38 347/105 |
| 2009/0086006 | A1* | 4/2009 | Koyabu | B41J 3/60 347/197 |
| 2010/0309275 | A1* | 12/2010 | Kokuta | B41J 2/32 347/217 |
| 2011/0170904 | A1* | 7/2011 | Sudo | B41J 25/316 399/110 |
| 2011/0188917 | A1* | 8/2011 | Naito | B41J 29/02 400/663 |
| 2012/0251174 | A1 | 10/2012 | Shirai et al. | |
| 2015/0053351 | A1* | 2/2015 | Tanaka | B29C 65/5092 156/538 |
| 2015/0202895 | A1* | 7/2015 | Nihashi | B41J 11/007 347/218 |
| 2017/0120648 | A1* | 5/2017 | Satoh | B41J 3/00 |
| 2019/0094767 | A1* | 3/2019 | Sakai | G03G 15/2042 |

FOREIGN PATENT DOCUMENTS

| | | | |
|---|---|---|---|
| JP | 2003-1976 | A | 1/2003 |
| JP | 2003-136693 | A | 5/2003 |
| JP | 2012-215836 | A | 11/2012 |

OTHER PUBLICATIONS

International Preliminary Report on Patentability issued in corresponding International Patent Application No. PCT/JP2019/020633, dated Jul. 27, 2021.

* cited by examiner

LAYER TRANSFERRING DEVICE INCLUDING HEAT ROLLER PROVIDED IN MAIN CASING AND MOVABLE RELATIVE TO PRESSURE ROLLER PROVIDED AT COVER

CROSS REFERENCE TO RELATED APPLICATION

This is a by-pass continuation application of International Application No. PCT/JP2019/020633 filed May 24, 2019 claiming priority from Japanese Patent Application No. 2019-014626 filed Jan. 30, 2019. The entire contents of the International Application and the priority application are incorporated herein by reference.

TECHNICAL FIELD

The present disclosure relates to a layer transferring device.

BACKGROUND

There has been known a layer transferring device for applying heat and pressure to a multilayer film including a transfer layer and a sheet to transfer the transfer layer onto the sheet. The multilayer film includes a supporting layer and a supported layer including the transfer layer. Such conventional layer transferring device is disclosed in Japanese Patent Application publication No. 2012-215836.

SUMMARY

In the conventional layer transferring device disclosed in the '836 publication, there is a demand for a replacement of the multilayer film with a new multilayer film, and a demand for preventing excessive application of heat to the multilayer film accommodated in a main casing.

However, with the conventional layer transferring device, in a case where the main casing is formed with an opening for the purpose of replacing the multilayer film and a heat roller is movably provided in the main casing for the purpose of suppressing excessive application of heat to the multilayer film, a position of a pressure roller becomes problematic.

In the above configuration, it is conceivable that the pressure roller be provided at a cover for closing the opening. However, this configuration finds difficulty in transmitting a driving force from the main casing to the pressure roller provided at the cover.

In view of the foregoing, it is an object of the present disclosure to provide a layer transferring device in which a driving force from a main casing to a pressure roller provided at a cover can be transmitted while enabling a replacement operation of the multilayer film with a new multilayer film and avoiding excessive application of heat to the multilayer film.

In order to attain the above and other objects, according to one aspect, the disclosure provides a layer transferring device including: a main casing; a cover; a pressure roller; a heat roller; a film cartridge; a motor; a first transmission gear; and a second transmission gear. The main casing is formed with an opening. The cover is pivotally movable about a pivot axis extending in a first direction between: a closed position where the cover closes the opening; and an open position where the cover opens the opening. The pressure roller is provided at the cover. The heat roller is provided in the main casing. The heat roller is movable in a second direction crossing the first direction while the cover is at the closed position between: a first position where the heat roller is in proximity to the pressure roller; and a second position where the heat roller is in separation from the pressure roller. The film cartridge is attachable to the main casing through the opening while the cover is at the open position. The film cartridge includes a multilayer film passing through a portion between the pressure roller and the heat roller in a third direction crossing both the first direction and the second direction in a state where the film cartridge is attached to the main casing and the cover is at the closed position. The motor is provided in the main casing. The first transmission gear is provided in the main casing and configured to receive a driving force from the motor. The second transmission gear is provided at the cover and configured to transmit a driving force to the pressure roller. The second transmission gear is in meshing engagement with the first transmission gear while the cover is at the closed position. The second transmission gear and the first transmission gear are positioned between the heat roller and the pivot axis of the cover while the cover is at the closed position.

BRIEF DESCRIPTION OF THE DRAWINGS

The particular features and advantages of the embodiment as well as other objects will become apparent from the following description taken in connection with the accompanying drawings, in which.

DETAILED DESCRIPTION

Figure 1:
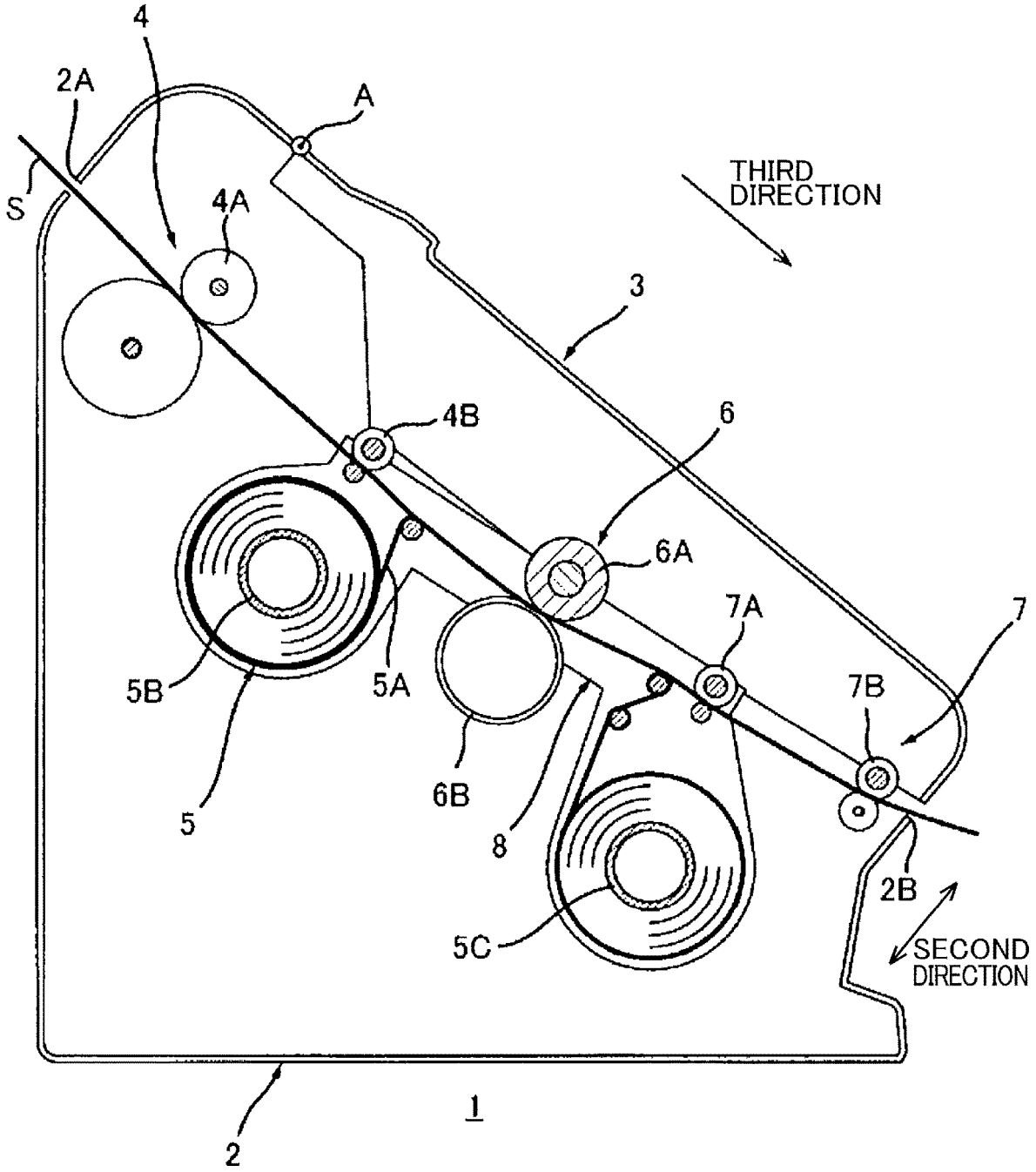
FIG. 1 is a cross-sectional view illustrating an overall configuration of a layer transferring device according to one embodiment of the present disclosure, and illustrating a state where a cover is in its closing position and a heat roller is in its first position.

Hereinafter, a layer transferring device 1 according to one embodiment of the present disclosure will be described with reference to the accompanying drawings, wherein like parts and components are designated by the same reference numerals to avoid the duplicating description.

1. Overall Configuration of Layer Transferring Device

An overall configuration of the layer transferring device 1 will be described with reference to FIGS. 1 through 5.

As illustrated in FIG. 1, the layer transferring device 1 includes a main casing 2, a cover 3, a sheet conveying unit 4, a film cartridge 5, a holder 8, a transferring unit 6, and a sheet discharging unit 7.

1.1 Main Casing

The main casing 2 is formed with a sheet inlet opening 2A and a sheet outlet opening 2B. The sheet inlet opening 2A allows a sheet S to be conveyed to the sheet conveying unit 4, and the sheet outlet opening 2B allows the sheet S to be discharged out of the main casing 2 by the sheet discharging unit 7.

Figure 3:
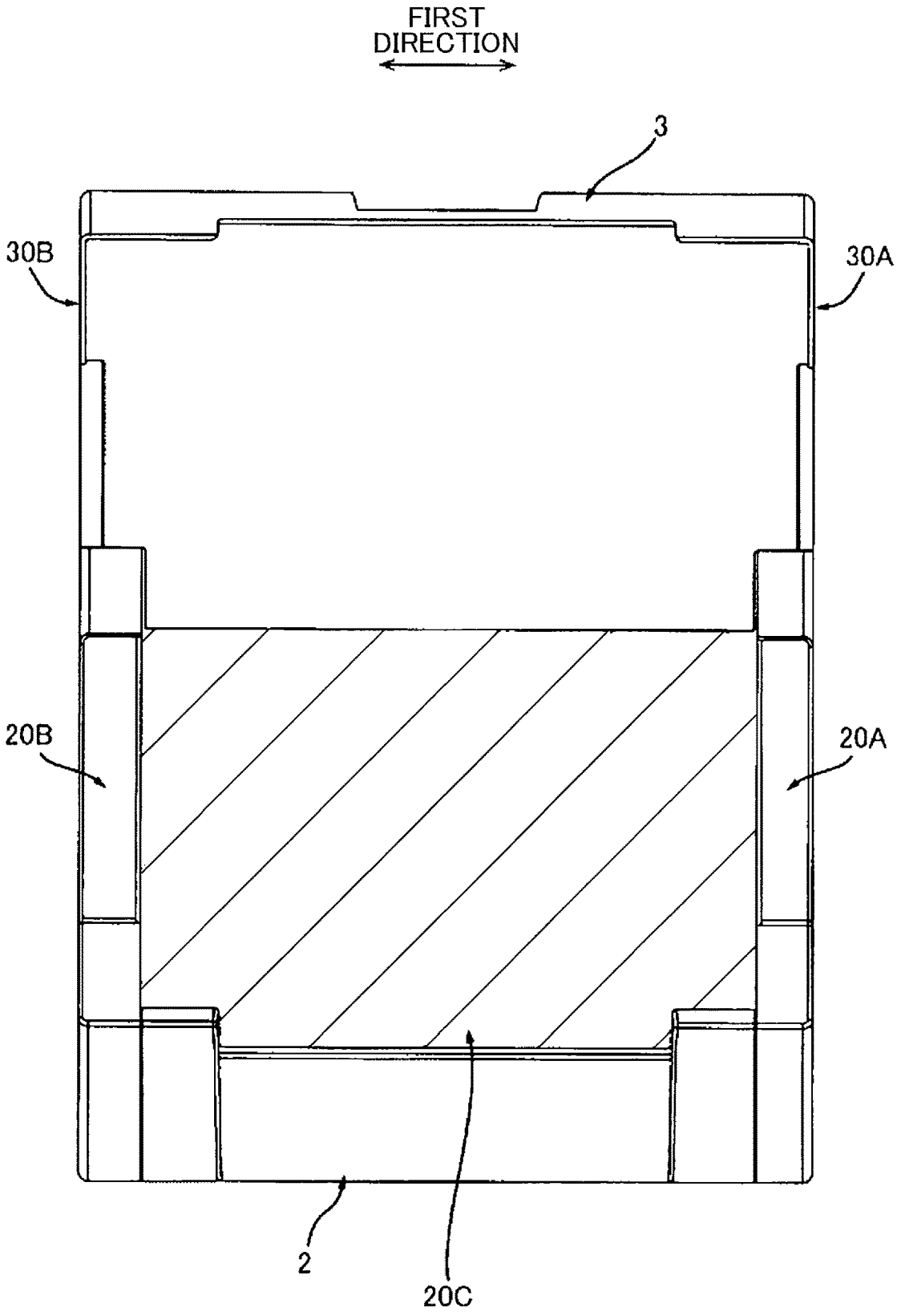
FIG. 3 is a front view of the layer transferring device illustrated in FIG. 2.

Further, as illustrated in FIG. 3, the main casing 2 includes main side walls 20A and 20B, and is formed with an opening 20C. The main side wall 20A serves as one side wall of the main casing 2 in a first direction, and the main side wall 20B serves as another side wall of the main casing 2 in the first direction. The main side wall 20B is spaced apart from the main side wall 20A in the first direction. The opening 20C is an opening region as indicated by a hatching in FIG. 3 defined between the main side walls 20A and 20B in the first direction.

1.2 Cover

Figure 2:
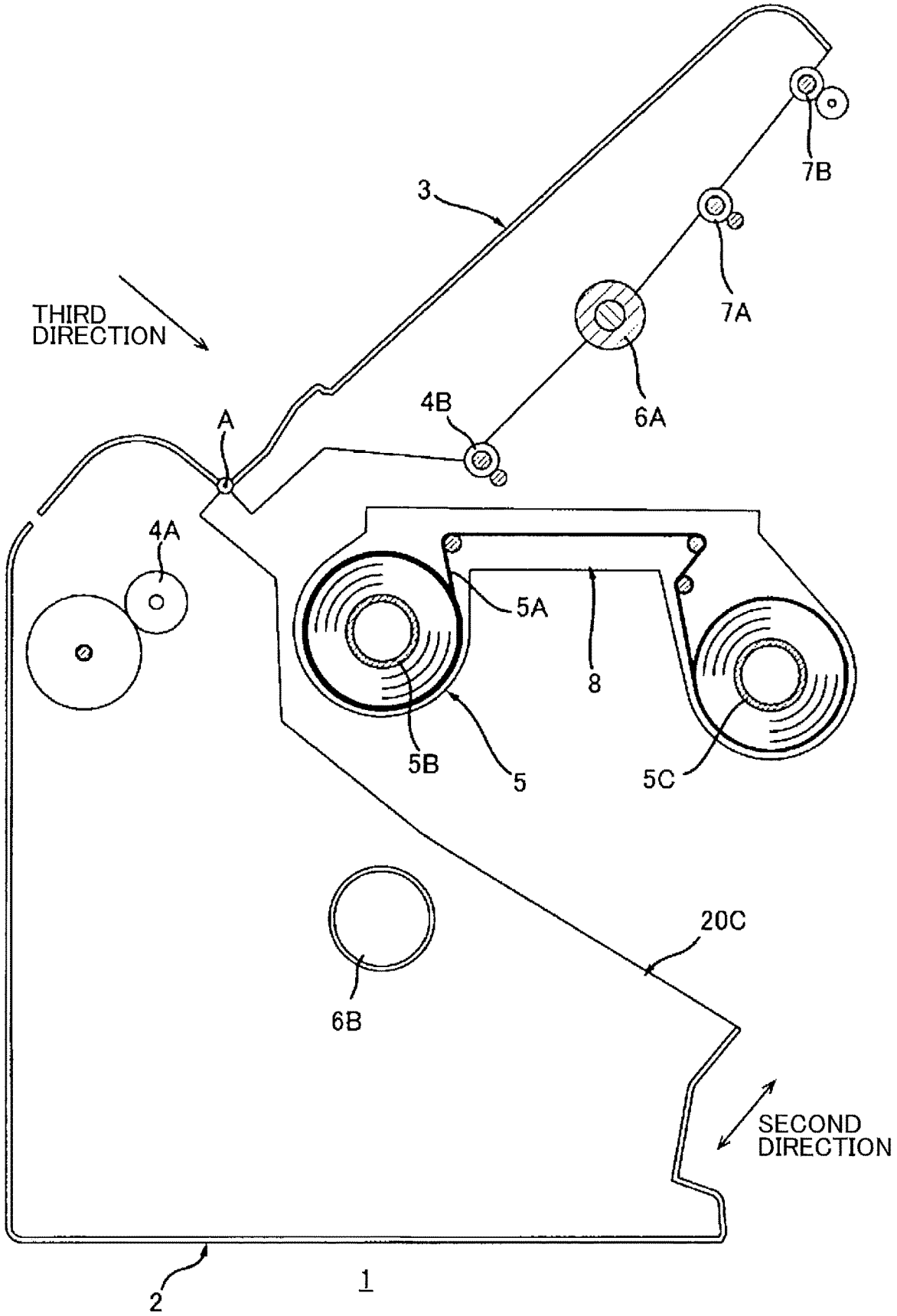
FIG. 2 is a cross-sectional view of the layer transferring device according to the embodiment, and illustrating a state where the cover is in its open position.

As illustrated in FIGS. 1 and 2, the cover 3 is pivotally movable relative to the main casing 2. Specifically, the cover 3 is pivotally movable between a closed position (see FIG. 1) where the cover 3 closes the opening 20C and an open position (see FIG. 2) where the cover 3 opens the opening 20C about a pivot axis A extending in the first direction.

The cover 3 includes cover side walls 30A and 30B, as illustrated in FIG. 3. The cover side wall 30A serves as one side wall of the cover 3 in the first direction, and the cover side wall 30B serves another side wall of the cover 3 in the first direction. The cover side wall 30B is positioned to be spaced apart from the cover side wall 30A in the first direction.

1.3 Sheet Conveying Unit

As illustrated in FIG. 1, a sheet S is to be supplied to the sheet conveying unit 4 in a state where the film cartridge 5 is attached to the main casing 2 and the cover 3 is in the closed position. The sheet conveying unit 4 is configured to convey the supplied sheet S toward the transferring unit 6. Specifically, the sheet conveying unit 4 includes a pick-up roller 4A and a conveying roller 4B. That is, the layer transferring device 1 includes the conveying roller 4B.

The pick-up roller 4A is provided inside the main casing 2. The pick-up roller 4A is configured to convey the sheet S supplied through the sheet inlet opening 2A toward the conveying roller 4B.

The conveying roller 4B is provided at the cover 3. The conveying roller 4B is configured to convey the sheet S conveyed by the pick-up roller 4A toward a pressure roller 6A (described later) of the transferring unit 6. The conveying roller 4B extends in the first direction, and is rotatable about an axis extending in the first direction.

1.4 Film Cartridge

As illustrated in FIG. 2, the film cartridge 5 is attachable to the main casing 2 through the opening 20C when the cover 3 is at the open position. The film cartridge 5 includes a multilayer film 5A, a feed reel 5B, and a take-up reel 5C.

1.4.1 Multilayer Film

Figure 4A:
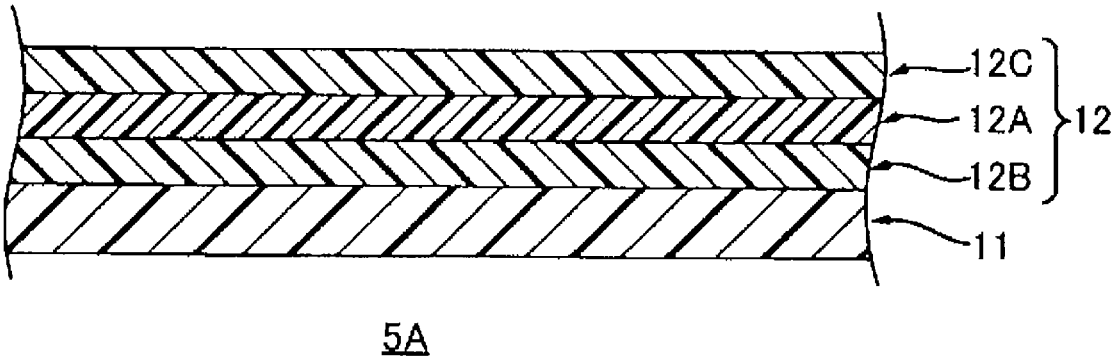
FIG. 4A is a cross-sectional view of a multilayer film illustrated in FIG. 1.

As illustrated in FIG. 4A, the multilayer film 5A includes a supporting layer 11 and a supported layer 12. The supporting layer 11 is a film made of resin such as polyethylene terephthalate and polyolefin. The supported layer 12 is supported by the supporting layer 11. The supported layer 12 includes a transfer layer 12A, a release layer 12B, and an adhesive layer 12C.

The transfer layer 12A is a layer to be transferred onto the sheet S. As the transfer layer 12A is transferred onto the sheet S, an image such as character(s) and pattern is formed on the sheet S. The transfer layer 12A contains a metal layer, a pigmented layer, or a protective layer, for example.

The metal layer is made of metal such as aluminum, tin, gold, and silver. In a case where the transfer layer 12A contains the metal layer, an image having metallic luster is formed on the sheet S upon transfer of the metal layer to the sheet S. The pigmented layer is made of, for example, thermoplastic resin containing colorant or pigment. In a case where the transfer layer 12A contains the pigmented layer, a color image is formed on the sheet S upon transfer of the pigmented layer to the sheet S. The protective layer is made of a transparent thermoplastic resin not containing colorant or pigment, for example. In a case where the protective layer contains the transfer layer 12A, a part of the sheet S is protected by the protective layer upon transfer of the protective layer to the sheet S.

Figure 4B:
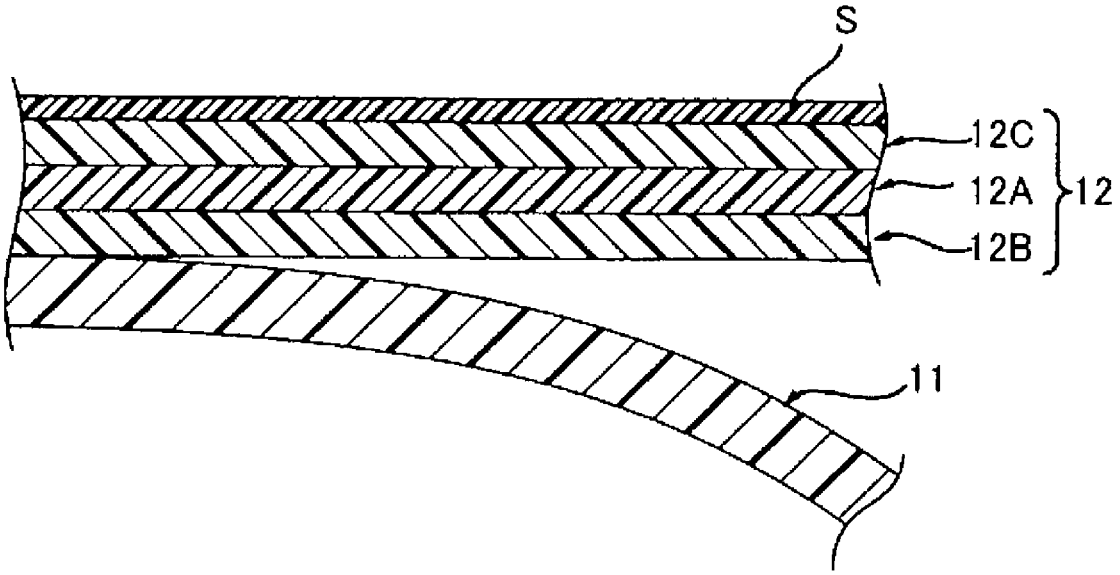
FIG. 4B is a cross-sectional view of the multilayer film illustrated in FIG. 4A in which a supporting layer is peeled off from a supported layer.

The release layer 12B is interposed between the supporting layer 11 and the transfer layer 12A. With this arrangement, the transfer layer 12A can be peeled from the supporting layer 11 by way of the release layer 12B as a boundary of separation, as illustrated in FIG. 4B.

The adhesive layer 12C is provided for adhering the transfer layer 12A to the sheet S. The adhesive layer 12C makes contact with the sheet S in a state where the multilayer film 5A is in contact with the sheet S. Further, in this state, the adhesive layer 12C is positioned between the transfer layer 12A and the sheet S upon contact of the multilayer film 5A with the sheet S. The adhesive layer 12C is made of thermoplastic resin such as vinyl chloride and acrylic resin.

1.4.2 Feed Reel

As illustrated in FIG. 1. the multilayer film 5A to be supplied to the transferring unit 6 is wounded around the feed reel 5B. The feed reel 5B has a hollow cylindrical shape. In a state where the film cartridge 5 is attached to the main casing 2, the feed reel 5B extends in the first direction and is rotatable about an axis extending in the first direction.

1.4.3 Take-Up Reel

The take-up reel 5C is positioned away from the feed reel 5B. According to the present embodiment, in a state where the film cartridge 5 is attached to the main casing 2, the take-up reel 5C is positioned opposite to the feed reel 5B with respect to the transferring unit 6. The take-up reel 5C is configured to take up the supporting layer 11 of the multilayer film 5A. The take-up reel 5C has a hollow cylindrical shape. The take-up reel 5C extends in the first direction and is rotatable about an axis extending in the first direction in the attached state of the film cartridge 5 to the main casing 2.

1.5 Holder

The holder 8 holds the film cartridge 5. The holder 8 is attachable to the main casing 2 through the opening 20C in the state where the cover 3 is at the open position as illustrated in FIG. 2. The holder 8 is attachable to the main casing 2 while holding the film cartridge 5. In other words, the film cartridge 5 is attachable to the main casing 2 while being held by the holder 8.

Incidentally, the film cartridge 5 may be held by the holder 8 so as to be attachable to and detachable from the holder 8. In the latter case, in order to replace the film cartridge 5 with a new film cartridge 5, the holder 8 supporting the film cartridge 5 is detached from the main casing 2 through the opening 20C while the cover 3 is at the open position. Then, the film cartridge 5 is detached from the holder 8 and a new film cartridge is attached thereto. The holder 8 holding the new film cartridge 5 is attached to the main casing 2 through the opening 20C.

As a still alternative, the holder 8 may be omitted from the layer transferring device 1. In the latter case, the film cartridge 5 may be directly attached to the main casing 2.

1.6 Transferring Unit

The transferring unit 6 is configured to transfer the transfer layer 12A of the multilayer film 5A onto the sheet S conveyed by the sheet conveying unit 4. The transferring unit 6 includes the pressure roller 6A and a heat roller 6B. That is, the layer transferring device 1 includes the pressure roller 6A and the heat roller 6B.

1.6.1 Pressure Roller

The pressure roller 6A is provided on the cover 3 at a position away from the pivot axis A. The pressure roller 6A makes contact with the supported layer 12 (see FIG. 4A) of the multilayer film 5A in a state where the film cartridge 5 is attached to the main casing 2 and the cover 3 is at the closed position. In other words, the supported layer 12 makes contact with the pressure roller 6A in the state where the film cartridge 5 is attached to the main casing 2 and the cover 3 is at the closed position. Specifically, the pressure roller 6A makes contact with the adhesive layer 12C in the state where the film cartridge 5 is attached to the main casing 2 and the cover 3 is in the closed position.

1.6.2 Heat Roller

Figure 5:
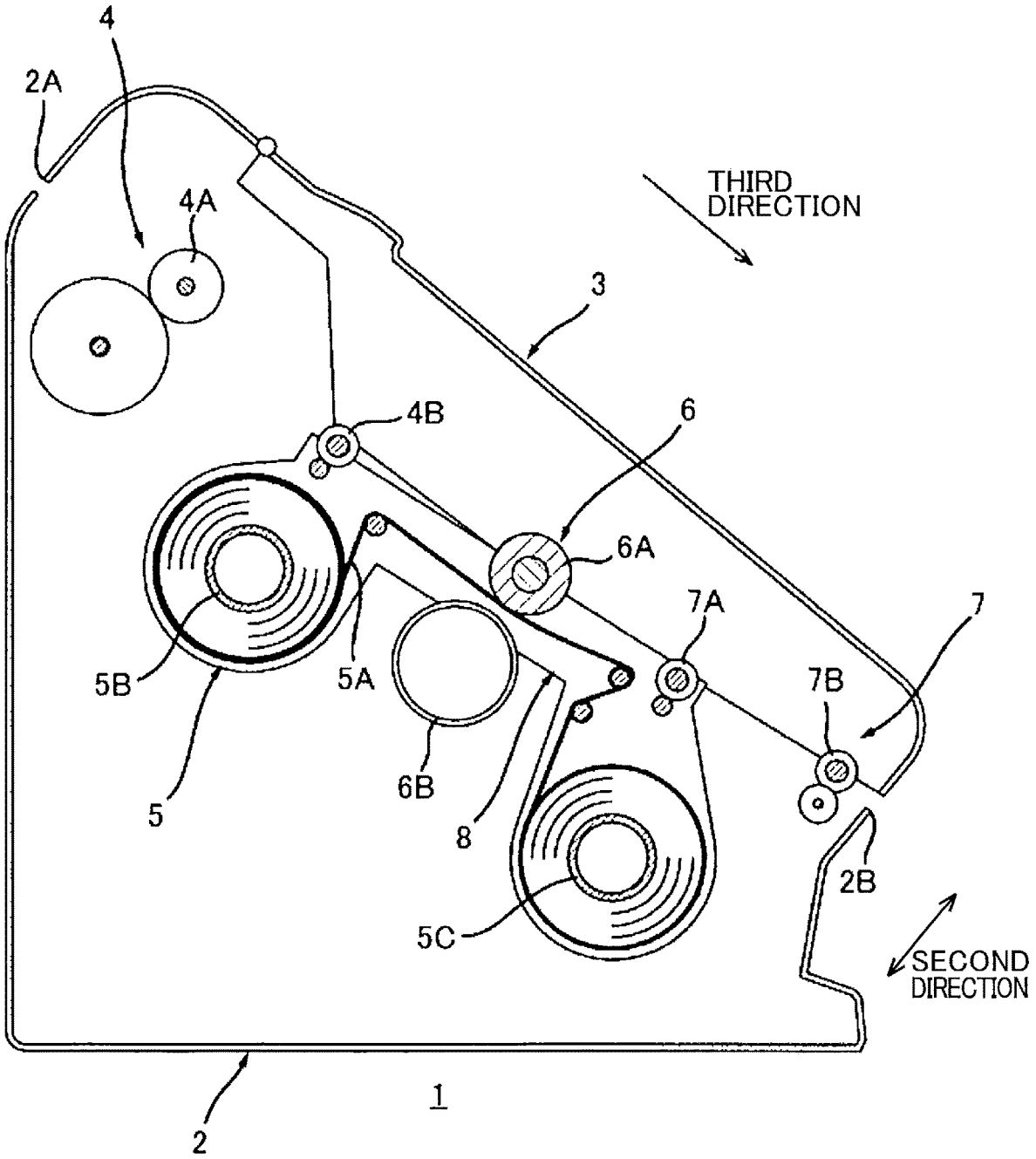
FIG. 5 is a cross-sectional view of the layer transferring device according to the embodiment, and illustrating a state where the heat roller is in its second position.

The heat roller 6B is positioned inside the main casing 2. The heat roller 6B is positioned between the feed reel 5B and the take-up reel 5C of the film cartridge 5 in the attached state of the film cartridge 5 to the main casing 2. As illustrated in FIGS. 1 and 5, the heat roller 6B is movable in a second direction crossing the first direction between a first position (see FIG. 1) and a second position (see FIG. 5) in the state where the cover 3 is at the closed position.

As illustrated in FIG. 1, when the heat roller 6B is at the first position while the cover 3 is at the closed position, the heat roller 6B at the first position is in proximity to the pressure roller 6A. Specifically, the heat roller 6B makes contact with the supporting layer 11 (see FIG. 4A) of the multilayer film 5A in a state where the film cartridge 5 is attached to the main casing 2, the pressure roller 6A is at the first position, and the cover 3 is at the closed position. Put another way, the supporting layer 11 contacts the heat roller 6B at the first position in the state where the film cartridge 5 is attached to the main casing 2 and the cover 3 is at the closed position.

The multilayer film 5A paid out from the feed reel 5B and taken up by the take-up reel 5C passes through a portion between the pressure roller 6A and the heat roller 6B in a third direction crossing both the first direction and the second direction in the state where the film cartridge 5 is attached to the main casing 2 and the cover 3 is at the closed position.

The sheet S supplied to the sheet conveying unit 4 is conveyed toward the transferring unit 6 by the pick-up roller 4A and the conveying roller 4B, and passes through the portion between the pressure roller 6A and the heat roller 6B in superimposed relation to the multilayer film 5A. At this time, heat is applied by the heat roller 6B, and pressure is applied by the pressure roller 6A and the heat roller 6B to the sheet S and the multilayer film 5A. As a result, the transfer layer 12A of the multilayer film 5A is adhered to the sheet S through the adhesive layer 12C.

Then, the supporting layer 11 is peeled off the transfer layer 12A at the release layer 12B as a boundary as illustrated in FIG. 4B by the supporting layer 11 being taken up by the take-up reel 5C while the transfer layer 12A is adhered to the sheet S. The transfer layer 12A is transferred to the sheet S from the supporting layer 11 in this way.

In the meantime, the heat roller 6B is in separation from the pressure roller 6A in a state where the heat roller 6B is at the second position while the cover 3 is at the closed position, as illustrated in FIG. 5. The heat roller 6B at the second position is spaced apart from the multilayer film 5A in the state where the film cartridge 5 is attached to the main casing 2 and the cover 3 is at the closed position. With the above configuration, application of unnecessary heat and pressure to the multilayer film 5A can be prevented by positioning the heat roller 6B at the second position at a timing at which heat and pressure need not be applied to the multilayer film 5A. For example, the heat roller 6B is placed at the second position in a state where a sheet S is not supplied to the sheet conveying unit 4.

1.7 Sheet Discharging Unit

The sheet discharging unit 7 illustrated in FIG. 1 is configured to discharge the sheet S that has moved past the portion between the pressure roller 6A and the heat roller 6B out of the layer transferring device 1. The sheet discharging unit 7 includes a conveying roller 7A and a sheet discharging roller 7B. That is, the layer transferring device 1 includes the sheet discharging roller 7B.

The conveying roller 7A is provided at the cover 3. The conveying roller 7A is configured to convey the sheet S passed through the portion between the pressure roller 6A and the heat roller 6B toward the sheet discharging roller 7B.

The sheet discharging roller 7B is also provided at the cover 3. The sheet discharging roller 7B is positioned opposite to the pivot axis A of the cover 3 with respect to the pressure roller 6A. The sheet discharging roller 7B is configured to discharge the sheet S conveyed by the conveying roller 7A to an outside of the layer transferring device 1.

2. Details of Layer Transferring Device

Next, Details of the layer transferring device 1 will be described with reference to FIGS. 6 through 10.

Figure 6:
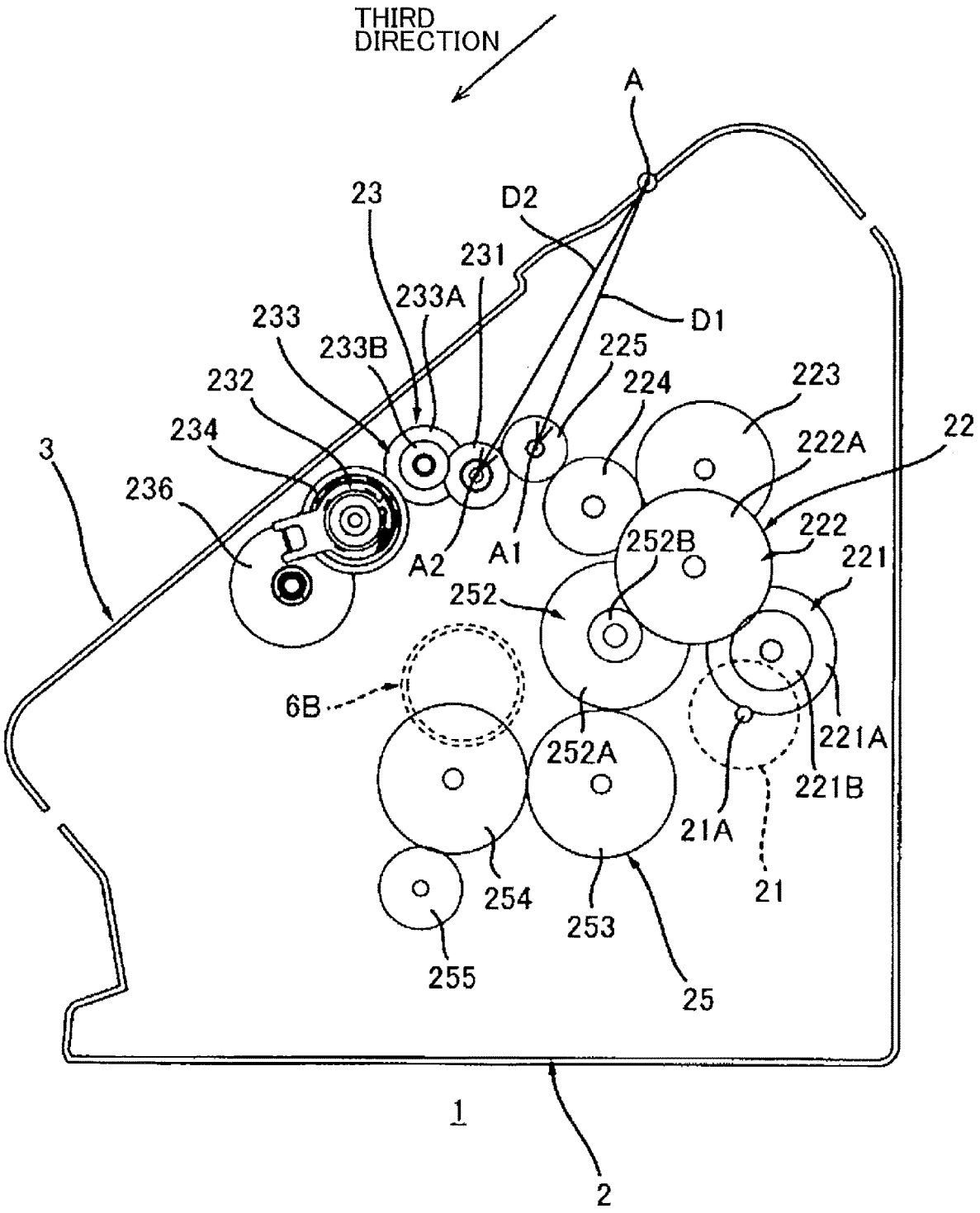
FIG. 6 is a schematic side view illustrating gear trains provided on one side wall of a main casing in the layer transferring device according to the embodiment.
Figure 7:
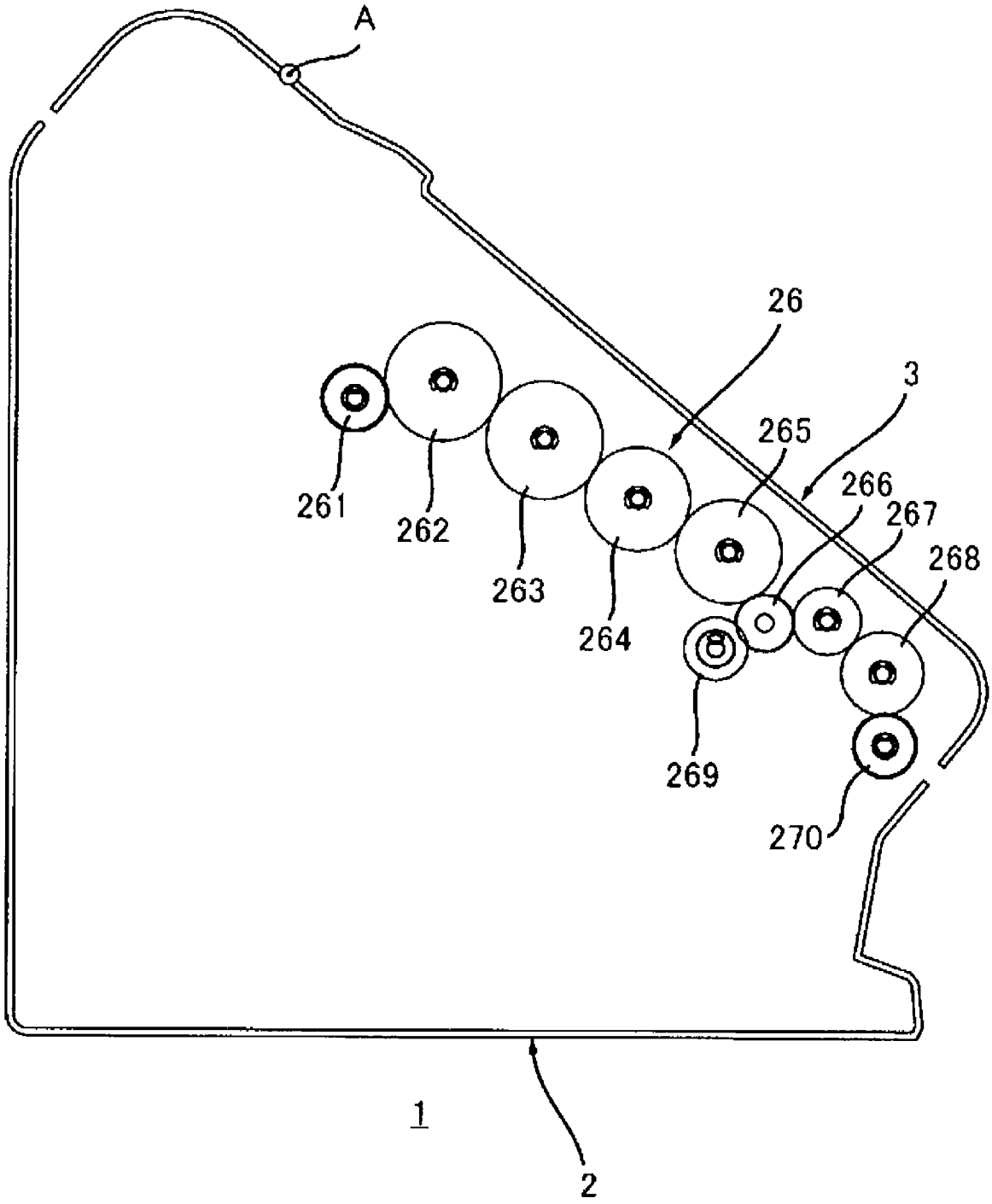
FIG. 7 is a schematic side view illustrating gear trains provided on another side wall of the main casing in the layer transferring device according to the embodiment.
Figure 8:
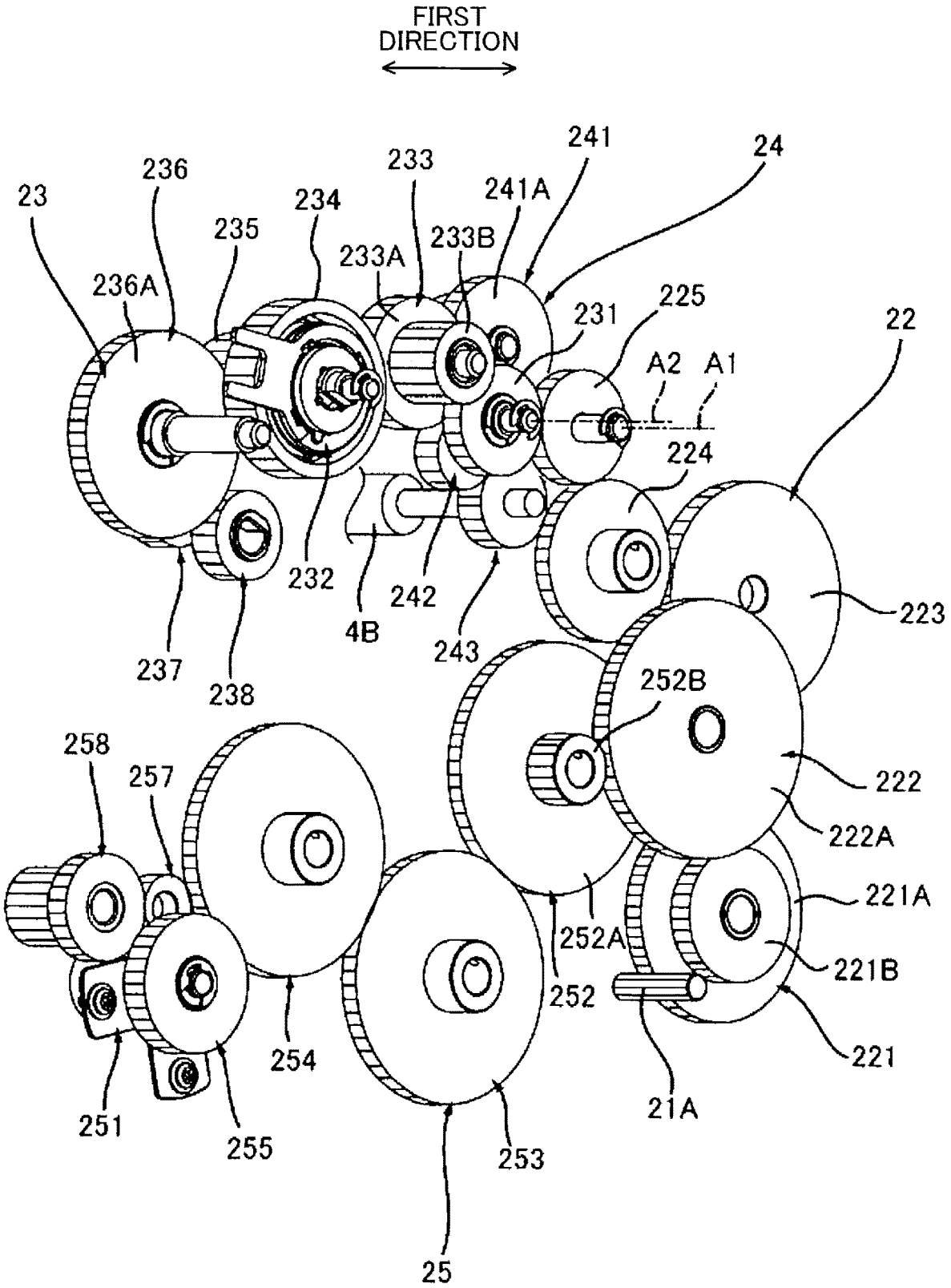
FIG. 8 is a perspective view of the gear trains illustrated in FIG. 6.

As illustrated in FIGS. 6 through 8, the layer transferring device 1 further includes a motor 21 (see FIG. 6), a first gear train 22 (see FIG. 6), a second gear train 23 (see FIG. 6), a third gear train 24 (see FIG. 8), a fourth gear train 25 (see FIG. 6), and a fifth gear train 26 (see FIG. 7).

2.1 Motor

As illustrated in FIG. 6, the motor 21 is positioned inside the main casing 2. Specifically, the motor 21 is attached to the main side wall 20A (see FIG. 3) of the main casing 2. The motor 21 includes a shaft (not illustrated) and an output gear 21A fixed to the shaft. The output gear 21A is rotatable together with the shaft about an axis extending in an axial direction (i.e., the first direction).

2.2 First Gear Train

Figure 9:
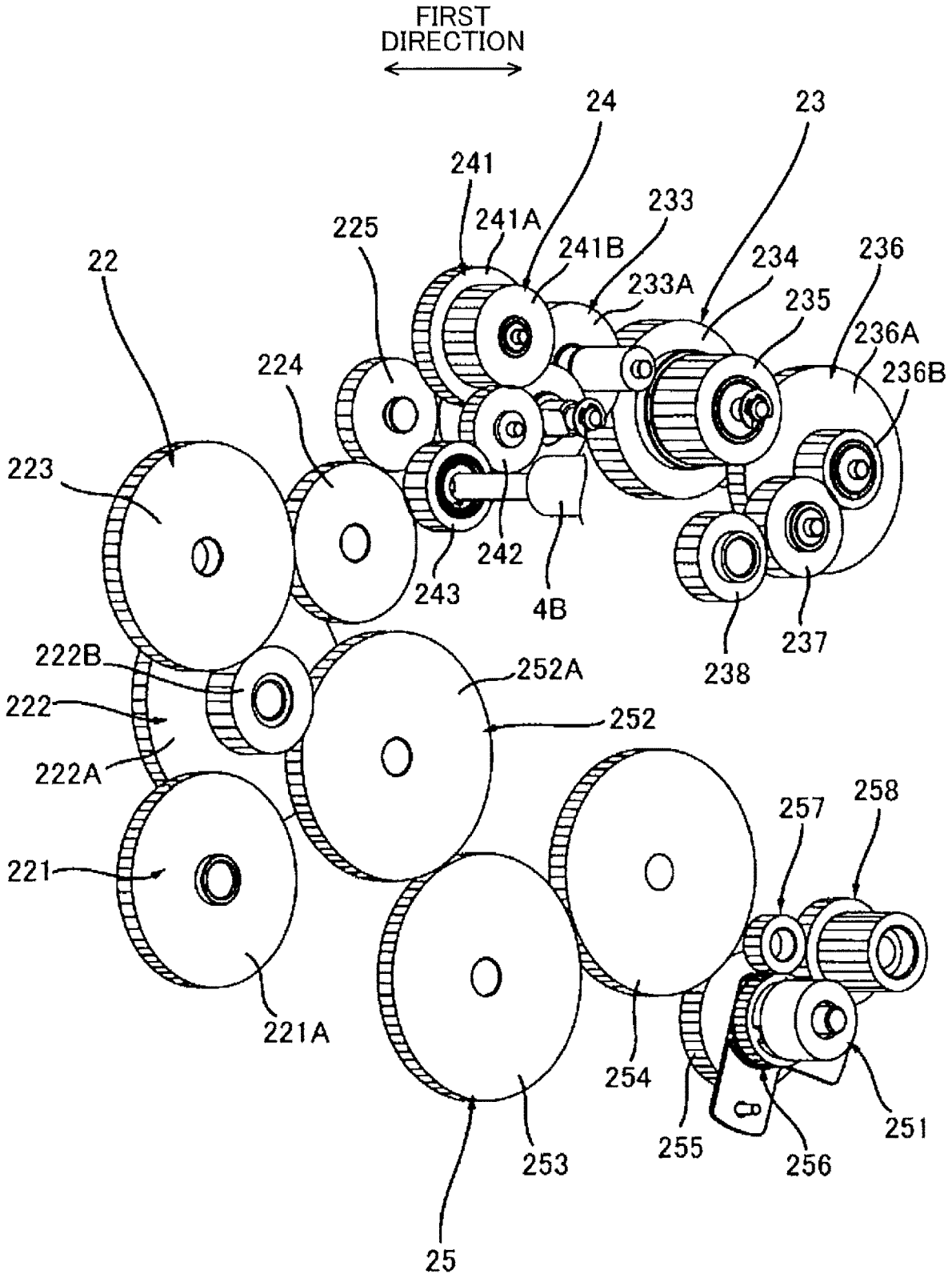
FIG. 9 is another perspective view of the gear trains illustrated in FIG. 6 as viewed in a direction different from a direction in FIG. 8.

As illustrated in FIG. 6, the first gear train 22 is positioned inside the main casing 2. Specifically, the first gear train 22 is attached to the main side wall 20A of the main casing 2. The first gear train 22 is configured to receive a driving force from the motor 21, and to transmit the driving force from the motor 21 to the second gear train 23 and the fourth gear train 25. As illustrated in FIGS. 6, 8 and 9, the first gear train 22 includes a plurality of idle gears 221, 222, 223 and 224, and a first transmission gear 225. That is, the first transmission gear 225 is positioned inside the main casing 2.

2.2.1 Idle Gears

The idle gear 221 is double gears including a large-diameter gear 221A and a small-diameter gear 221B. The large-diameter gear 221A is in meshing engagement with the output gear 21A of the motor 21. The small-diameter gear 221B is rotatable along with the large-diameter gear 221A. The small-diameter gear 221B has a diameter smaller than a diameter of the large-diameter gear 221A. Further, the number of gear teeth of the small-diameter gear 221B is smaller than the number of gear teeth of the large-diameter gear 221A.

The idle gear 222 is double gears including a large-diameter gear 222A and a small-diameter gear 222B (see FIG. 9). The large-diameter gear 222A is in meshing engagement with the small-diameter gear 221B of the idle gear 221. The small-diameter gear 222B is rotatable along with the large-diameter gear 222A. The small-diameter gear 222B has a diameter smaller than a diameter of the large-diameter gear 222A. The number of gear teeth of the small-diameter gear 222B is smaller than the number of gear teeth of the large-diameter gear 222A.

The idle gear 223 is in meshing engagement with the small-diameter gear 222B of the idle gear 222. The idle gear 224 is in meshing engagement with the idle gear 223.

2.2.2 First Transmission Gear

The first transmission gear 225 is in meshing engagement with the idle gear 224. The first transmission gear 225 is rotatable about a first axis A1 extending in the first direction. Accordingly, a driving force from the motor 21 is transmitted to the first transmission gear 225 through the plurality of idle gears 221, 222, 223 and 224. As illustrated in FIG. 6, the first transmission gear 225 is positioned between the heat roller 6B and the pivot axis A of the cover 3 in the third direction. The first transmission gear 225 is covered with the main side wall 20A in the first direction.

2.3 Second Gear Train

As illustrated in FIG. 6, the second gear train 23 is provided on the cover 3. Specifically, the second gear train 23 is attached to the cover side wall 30A (see FIG. 3) of the cover 3. The second gear train 23 is configured to transmit a driving force transmitted from the first transmission gear 225 of the first gear train 22 to the pressure roller 6A. More specifically, as illustrated in FIGS. 6, 8 and 9, the second gear train 23 includes a second transmission gear 231, a clutch 232, a plurality of idle gears 233, 234, 235, 236 and 237, and a pressure roller gear 238. That is, the layer transferring device 1 includes the second transmission gear 231 provided at the cover 3 and configured to transmit a driving force to the pressure roller 6A.

2.3.1 Second Transmission Gear

As illustrated in FIG. 6, the second transmission gear 231 is in meshing engagement with the first transmission gear 225 in the state where the cover 3 is at the closed position. The second transmission gear 231 is rotatable about a second axis A2 extending in the first direction. With this configuration, a driving force of the motor 21 is transmitted to the second gear train 23 through the first gear train 22 in the state where the cover 3 is in the closed position. The second transmission gear 231 is positioned between the heat roller 6B and the pivot axis A of the cover 3 in the third direction at the closed position of the cover 3.

Here, a distance D2 between the second axis A2 of the second transmission gear 231 and the pivot axis A of the cover 3 is different from a distance D1 between the first axis A1 of the first transmission gear 225 and the pivot axis A of the cover 3. In the present embodiment, the distance D2 is greater than the distance D1. Alternatively, the distance D2 may be smaller than the distance D1. Because of the difference between the distances D1 and D2 from each other, the second transmission gear 231 can be smoothly brought into meshing engagement with the first transmission gear 225 in response to the movement of the cover 3 from the open position to the closed position. The second transmission gear 231 is covered with the cover side wall 30A (see FIG. 3) in the first direction.

2.3.2 Clutch

As illustrated in FIG. 8, the clutch 232 is provided at a position in the middle of the second gear train 23. The clutch 232 is switchable between a transmission state and an interruption state. Transmission of a driving force from the second gear train 23 to the pressure roller 6A can be attained in the transmission state of the clutch 232, whereas the transmission of the driving force from the second gear train 23 to the pressure roller 6A is interrupted in the interruption state of the clutch 232.

Specifically, the clutch 232 is positioned between the idle gears 234 and 235. The clutch 232 can transmit a driving force from the idle gear 234 to the idle gear 235 in the state where the clutch 232 is in the transmission state. Accordingly, the driving force can be transmitted from the second gear train 23 to the pressure roller 6A in the transmission state of the clutch 232. On the other hand, the clutch 232 in the interruption state cannot transmit a driving force from the idle gear 234 to the idle gear 235. Hence, the driving force cannot be transmitted from the second gear train 23 to the pressure roller 6A in the interruption state of the clutch 232.

The clutch 232 is an electromagnetic clutch in the present embodiment. The clutch 232 is switchable between an ON state upon energization and an OFF state upon de-energization. The clutch 232 becomes the transmission state when the clutch 232 is switched to the ON state, and becomes the interruption state when the clutch 232 is switched to the OFF state.

2.3.3 Idle Gears

The idle gear 233 is double gears including a large-diameter gear 233A and a small-diameter gear 233B. The small-diameter gear 233B is in meshing engagement with the second transmission gear 231. The small-diameter gear 233B is rotatable along with the large-diameter gear 233A. The small-diameter gear 233B has a diameter smaller than a diameter of the large-diameter gear 233A. Further, the number of gear teeth of the small-diameter gear 233B is smaller than the number of gear teeth of the large-diameter gear 233A.

The idle gear 234 is attached to the clutch 232. The idle gear 234 is in meshing engagement with the large-diameter gear 233A of the idle gear 233. The idle gear 235 is attached to the clutch 232. The idle gear 235 is rotatable together with the idle gear 234 in the transmission state of the clutch 232, and the rotation of the idle gear 235 is stopped in the interruption state of the clutch 232.

As illustrated in FIG. 9, the idle gear 236 is double gears including a large-diameter gear 236A and a small-diameter gear 236B. The large-diameter gear 236A is in meshing engagement with the idle gear 235. The small-diameter gear 236B is rotatable along with the large-diameter gear 236A. The small-diameter gear 236B has a diameter smaller than a diameter of the large-diameter gear 236A. Further, the number of gear teeth of the small-diameter gear 236B is smaller than the number of gear teeth of the large-diameter gear 236A. The idle gear 237 is in meshing engagement with the small-diameter gear 236B of the idle gear 236.

2.3.4 Pressure Roller Gear

The pressure roller gear 238 is in meshing engagement with the idle gear 237. The pressure roller gear 238 is coupled to one end portion in the first direction of the pressure roller 6A. Therefore, the pressure roller gear 238 is rotatable along with the rotation of the pressure roller 6A.

2.4 Third Gear Train

As illustrated in FIGS. 8 and 9, the third gear train 24 is connected to the second gear train 23. Specifically, the third gear train 24 is connected to an idle gear provided in the middle of the second gear train 23. It is preferable that the third gear train 24 is connected to an idle gear positioned between the second transmission gear 231 and the clutch 232. More specifically, the third gear train 24 is connected to the idle gear 233 of the second gear train 233.

The third gear train 24 is provided at the cover 3. Specifically, the third gear train 24 is attached to the cover side wall 30A of the cover 3. The third gear train 24 is configured to transmit a driving force from the idle gear 233 of the second gear train 23 to the conveying roller 4B (see FIG. 1). The third gear train 24 includes idle gears 241 and 242, and a first conveying roller gear 243 as illustrated in FIG. 9.

2.4.1 Idle Gears

The idle gear 241 is double gears including a large-diameter gear 241A and a small-diameter gear 241B. The large-diameter gear 241A is in meshing engagement with the large-diameter gear 233A (see FIG. 8) of the idle gear 233. The small-diameter gear 241B is rotatable along with the large-diameter gear 241A. The small-diameter gear 241B has a diameter smaller than a diameter of the large-diameter gear 241A. The number of gear teeth of the small-diameter gear 241B is smaller than the number of gear teeth of the large-diameter gear 241A. The idle gear 242 is in meshing engagement with the small-diameter gear 241B of the idle gear 241.

2.4.2 First Conveying Roller Gear

The first conveying roller gear 243 is in meshing engagement with the idle gear 242. The first conveying roller gear 243 is couple to one end portion in the first direction of the conveying roller 4B to be rotatable together with the rotation of the conveying roller 4B. With the above configuration, a driving force can be transmitted from the idle gear 233 of the second gear train 23 to the conveying roller 4B.

2.5 Fourth Gear Train

The fourth gear train 25 is positioned inside the main casing 2 as illustrated in FIG. 6. The fourth gear train 25 is attached to the main side wall 20A of the main casing 2. The fourth gear train 25 is connected to the first gear train 22 as illustrated in FIGS. 8 and 9. The fourth gear train 25 is connected to an idle gear provided in the middle of the first gear train 22. Preferably, the fourth gear train 25 is connected to an idle gear positioned between the output gear 21A and the first transmission gear 225. More specifically, the fourth gear train 25 is connected to the idle gear 222 of the first gear train 22.

The fourth gear train 25 is configured to transmit a driving force from the idle gear 222 of the first gear train 22 to the take-up reel 5C (see FIG. 1). The fourth gear train 25 includes a clutch 251, a plurality of idle gears 252, 253, 254, 255, 256 and 257, and a take-up reel gear 258.

2.5.1 Clutch

The clutch 251 is provided in the middle of the fourth gear train 25. The clutch 251 is switchable between a transmission state and an interruption state. A driving force can be transmitted from the fourth gear train 25 to the take-up reel 5C in a state where the clutch 251 is in the transmission state, whereas the transmission of the driving force from the fourth gear train 25 to the take-up reel 5C is interrupted in a state where the clutch 251 is in the interruption state.

Specifically, the clutch 251 is positioned between the idle gears 255 and 256. The clutch 251 in the transmission state can transmit a driving force from the idle gear 255 to the idle gear 252. In this way, the driving force can be transmitted from the fourth gear train 25 to the take-up reel 5C in the transmission state of the clutch 251. On the other hand, the clutch 251 in the interruption state interrupts the transmission of the driving force from the idle gear 255 to the idle gear 256. Hence, the driving force cannot be transmitted from the fourth gear train 25 to the take-up reel 5C in the interruption state of the clutch 251.

The clutch 251 is an electromagnetic clutch in the present embodiment. The clutch 251 is switchable between an ON state upon energization and an OFF state upon de-energization. The clutch 251 becomes the transmission state when the clutch 251 is switched to the ON state, and becomes the interruption state when the clutch is switched to the OFF state.

2.5.2 Idle Gears

The idle gear 252 is double gears and includes a large-diameter gear 252A and a small-diameter 252B. The small-diameter gear 252B is in meshing engagement with the large-diameter gear 222A of the idle gear 222. The small-diameter gear 252B is rotatable along with the large-diameter gear 252A. The small-diameter gear 252B has a diameter smaller than a diameter of the large-diameter gear 252A. Further, the number of gear teeth of the small-diameter gear 252B is smaller than the number of gear teeth of the large-diameter gear 252A.

The idle gear 253 is in meshing engagement with the large-diameter gear 252A of the idle gear 252. The idle gear 254 is in meshing engagement with the idle gear 253. The idle gear 255 is attached to the clutch 251. The idle gear 255 is in meshing engagement with the idle gear 254.

As illustrated in FIG. 9, the idle gear 256 is attached to the clutch 251. The idle gear 256 is rotatable together with the idle gear 255 in the transmission state of the clutch 251, but the idle gear 256 is not rotatable in the interruption state of the clutch 251. The idle gear 257 is in meshing engagement with the idle gear 256.

2.5.3 Take-Up Reel Gear

The take-up reel gear 258 is in meshing engagement with the idle gear 257. The take-up reel gear 258 is configured to transmit a driving force to the take-up reel 5C in the state where the film cartridge 5 is attached to the main casing 2. Specifically, the take-up reel gear 258 is connected to a gear train (not illustrated) provided in the film cartridge 5 in the attached state of the film cartridge 5 to the main casing 2. Hence, a driving force can be transmitted to the take-up reel 5C from the idle gear 222 of the first gear train 22.

Note that the take-up reel gear 258 may be engaged with one of gears of the gear train (not illustrated) provided in the film cartridge 5 to be connected to the gear train of the film cartridge 5. Alternatively, the take-up reel gear 258 may be connected to the gear train provided in the film cartridge 5 through a coupling (not illustrated).

2.6 Fifth Gear Train

As illustrated in FIG. 7, the fifth gear train 26 is provided at the cover 3. Specifically, the fifth gear train 26 is attached to the cover side wall 30B (see FIG. 3) of the cover 3. The fifth gear train 26 is configured to transmit a driving force from the conveying roller 4B to the conveying roller 7A and the sheet discharging roller 7B. Hence, a driving force from the motor 21 can be transmitted not only to the pressure roller 6A and the conveying roller 4B but also to the sheet discharging roller 7B through the second transmission gear 231 (see FIG. 6).

Figure 10:
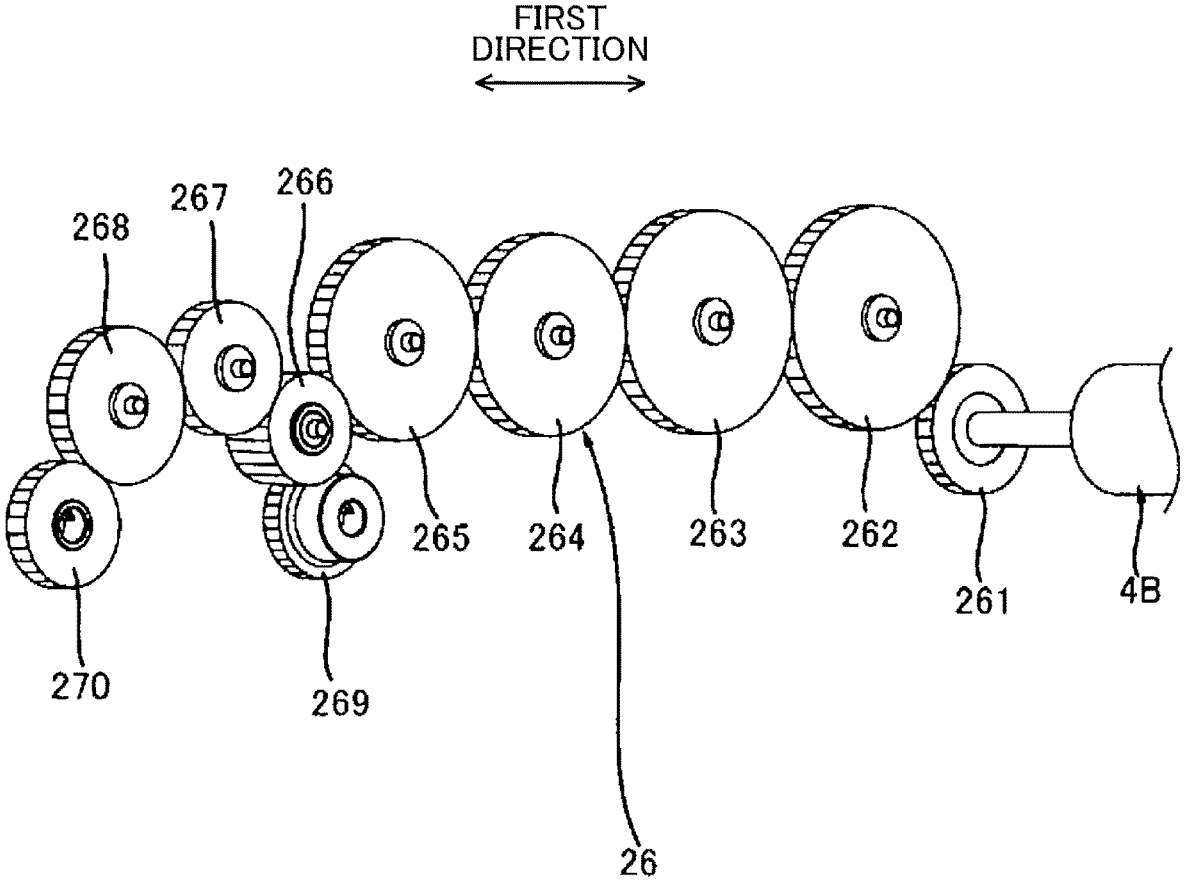
FIG. 10 is a perspective view of the gear trains illustrated in FIG. 7.

Specifically, as illustrated in FIG. 10, the fifth gear train 26 includes a second conveying roller gear 261, a plurality of idle gears 262, 263, 264, 265, 266, 267 and 268, a conveying roller gear 269, and a discharging roller gear 270.

2.6.1 Second Conveying Roller Gear

The second conveying roller gear 261 is coupled to another end portion in the first direction of the conveying roller 4B. The second conveying roller gear 261 is rotatable along with the rotation of the conveying roller 4B. Hence, a driving force can be transmitted from the first conveying roller gear 243 of the third gear train 24 to the second conveying roller gear 261 through the conveying roller 4B.

2.6.2 Idle Gears

The idle gear 262 is in meshing engagement with the second conveying roller gear 261. The idle gear 263 is in meshing engagement with the idle gear 262. The idle gear 264 is in meshing engagement with the idle gear 263. The idle gear 265 is in meshing engagement with the idle gear 264. The idle gear 266 is in meshing engagement with the idle gear 265. The idle gear 267 is in meshing engagement with the idle gear 266. The idle gear 268 is in meshing engagement with the idle gear 267.

2.6.3 Conveying Roller Gear

The conveying roller gear 269 is in meshing engagement with the idle gear 266. The conveying roller gear 269 is rotatable along with the conveying roller 7A (see FIG. 1). Accordingly, a driving force can be transmitted from the second conveying roller gear 261 to the conveying roller 7A through the plurality of idle gears 262, 263, 264, 265 and 266, and the conveying roller gear 269.

2.6.4 Discharging Roller Gear

The discharging roller gear 270 is in meshing engagement with the idle gear 268. The discharging roller gear 270 is rotatable along with the sheet discharging roller 7B. Hence, a driving force can be transmitted from the idle gear 266 to the sheet discharging roller 7B through the plurality of idle gears 267 and 268, and the discharging roller gear 270.

Here, the number of gears for transmitting a driving force from the motor 21 to the pressure roller 6A is smaller than the number of gears for transmitting a driving force from the motor 21 to the sheet discharging roller 7B.

Specifically, for transmitting a driving force from the motor 21 to the pressure roller 6A, twelve gears including the idle gears 221, 222, 223 and 224, the first transmission gear 225, the second transmission gear 231, the idle gears 233, 234, 235, 236, 237, and the pressure roller gear 238 are used as illustrated in FIG. 8.

On the other hand, as illustrated in FIGS. 8 and 10, for transmitting a driving force from the motor 21 to the sheet discharging roller 7B, nineteen gears including the idle gears 221, 222, 223 and 224, the first transmission gear 225, the second transmission gear 231, the idle gears 233, 241 and 242, the first conveying roller gear 243, the second conveying roller gear 261, the idle gears 262, 263, 264, 265, 266, 267 and 268, and the discharging roller gear 270 are used.

With this configuration, the pressure roller 6A requiring large torque can be driven by a driving force transmitted using the gears whose numbers are smaller than the numbers of gears for transmitting a driving force to the sheet discharging roller 7B. Hence, stabilized rotation of the pressure roller 6A can be attained.

3. Technical Advantages (1) According the layer transferring device 1 described above, the film cartridge 5 including the multilayer film 5A can be replaced with a new film cartridge 5 in a state where the cover 3 is at the open position as illustrated in FIG. 2.

Further, as illustrated in FIG. 5, the heat roller 6B is movable to the second position away from the pressure roller 6A while the cover 3 is at the closed position. Therefore, unnecessary application of heat to the multilayer film 5A can be restrained.

Further, as illustrated in FIG. 6, the first transmission gear 225 configured to receive a driving force from the motor 21 is transmitted and the second transmission gear 231 configured to transmit a driving force to the pressure roller 6A can be meshingly engaged with each other while the cover 3 is at the closed position. Hence, a driving force can be transmitted from the motor 21 positioned inside the main casing 2 to the pressure roller 6A provided at the cover 3.

Here, the first transmission gear 225 and the second transmission gear 231 are positioned between the heat roller 6B and the pivot axis A of the cover 3 in the state where the cover 3 is at the closed position. That is, the first transmission gear 225 and the second transmission gear 231 are in meshing engagement with each other at a position closer to the pivot axis A of the cover 3 than the heat roller 6B is to the pivot axis A.

Accordingly, disengagement between the first transmission gear 225 and the second transmission gear 231 from each other is unlikely to occur even if the pressure roller 6A receives a pressing force from the heat roller 6B, thereby attaining stabilized transmission of a driving force to the pressure roller 6A.

As a result, a driving force can be transmitted to the pressure roller 6A provided on the cover 3 while enabling a replacement of the multilayer film 5 with a new multilayer film 5 and restraining application of excessive heat to the multilayer film 5A.

(2) As illustrate in FIG. 6, the distance D2 between the second axis A2 of the second transmission gear 231 and the pivot axis A of the cover 3 is different from the distance D1 between the first axis A1 of the first transmission gear 225 and the pivot axis A. With this configuration, the second transmission gear 231 and the first transmission gear 225 are smoothly brought into meshing engagement with each other in accordance with the movement of the cover 3 from the open position to the closed position.

(3) Further, the first transmission gear 225 is covered with the main side wall 20A of the main casing 2 in the first direction, and the second transmission gear 231 is covered with the cover side wall 30A of the cover 3 in the first direction. With this configuration, the main side wall 20A can cover the first transmission gear 225 and the cover side wall 30A can cover the second transmission gear 231 in the state where the cover 3 is at the open position. As a result, the first transmission gear 225 and the second transmission gear 231 can be protected while the cover 3 is at the open position.

(4) Further, since the sheet discharging roller 7B is provided on the cover 3 as illustrated in FIG. 2, the sheet discharging roller 7B is positioned away from the main casing 2 together with the cover 3 when the cover 3 is at the open position. With this configuration, the sheet discharging roller 7B does not become an obstacle at a time of replacement of the film cartridge 5 with a new film cartridge 5. Further, the sheet discharging roller 7B can be driven by making use of the driving force transmitted to the pressure roller 6A.

(5) As illustrated in FIG. 8, for transmitting a driving force from the motor 21 to the pressure roller 6A, twelve gears are used including the idle gears 221, 222, 223 and 224, the first transmission gear 225, the second transmission gear 231, the idle gears 233, 234, 235, 236 and 237, and the pressure roller gear 238.

On the other hand, as illustrated in FIGS. 8 and 10, for transmitting a driving force from the motor 21 to the sheet discharging roller 7B, nineteen gears are used including the idle gears 221, 222, 223 and 224, the first transmission gear 225, the second transmission gear 231, the idle gears 233, 241 and 242, the first conveying roller gear 243, the second conveying roller gear 261, the idle gears 262, 263, 264, 265, 266, 267 and 268, and the discharging roller gear 270.

That is, the numbers of gears for transmitting a driving force from the motor 21 to the pressure roller 6A is smaller than the number of gears for transmitting a driving force from the motor 21 to the sheet discharging roller 7B. Therefore, the pressure roller 6A requiring large torque can be driven by a driving force transmitted through the gears whose numbers are smaller than the numbers of gears required for transmitting a driving force to the sheet discharging roller 7B, whereby stabilized rotation of the pressure roller 6A can be realized.

(6) As illustrated in FIG. 8, the second gear train 23 for transmitting a driving force to the pressure roller 6A and the fourth gear train 25 for transmitting a driving force to the take-up reel 5C are connected to the first gear train 22 to which a driving force from the motor 21 is transmitted. Further, the second gear train 23 includes the clutch 232.

With this configuration, the take-up reel 5C of the film cartridge 5 and the pressure roller 6A can be driven by the common motor 21, while the pressure roller 6A is rotatable independently of the rotation of the take-up reel 5C by virtue of the clutch 232.

Further, as illustrated in FIGS. 8 and 10, a driving force can be transmitted in the first direction from the second gear train 23 to the fifth gear train 26 by making use of the conveying roller 4B. Therefore, the fifth gear train 26 for transmitting a driving force to the sheet discharging roller 7B can be spaced apart from the second gear train 23 including the clutch 232 in the first direction. Hence, increase in size of the layer transferring device 1 can be avoided.

While the description has been made in detail with reference to embodiment, it would be apparent to those skilled in the art that various changes and modifications may be made thereto.

What is claimed is:

1. A layer transferring device comprising:

a main casing formed with an opening;

a cover pivotally movable about a pivot axis extending in a first direction between:

a closed position where the cover closes the opening; and an open position where the cover opens the opening;

a pressure roller provided at the cover;

a heat roller provided in the main casing, the heat roller being movable in a second direction crossing the first direction while the cover is at the closed position between:

a first position where the heat roller is in proximity to the pressure roller; and a second position where the heat roller is in separation from the pressure roller;

a film cartridge attachable to the main casing through the opening while the cover is at the open position, the film cartridge comprising a multilayer film passing through a portion between the pressure roller and the heat roller in a third direction crossing both the first direction and the second direction in a state where the film cartridge is attached to the main casing and the cover is at the closed position;

a motor provided in the main casing;

a first transmission gear provided in the main casing and configured to receive a driving force from the motor; and a second transmission gear provided at the cover and configured to transmit a driving force to the pressure roller, the second transmission gear being in meshing engagement with the first transmission gear while the cover is at the closed position, the second transmission gear and the first transmission gear being positioned between the heat roller and the pivot axis of the cover while the cover is at the closed position.

2. The layer transferring device according to claim 1, wherein the first transmission gear is rotatable about a first axis extending in the first direction, wherein the second transmission gear is rotatable about a second axis extending in the first direction, and wherein a distance between the second axis of the second transmission gear and the pivot axis of the cover is different from a distance between the first axis of the first transmission gear and the pivot axis of the cover.

3. The layer transferring device according to claim 1, wherein the main casing comprises a main side wall which is one side wall in the first direction of the main casing, wherein the cover comprises a cover side wall which is one side wall in the first direction of the cover, wherein the first transmission gear is covered with the main side wall in the first direction, and wherein the second transmission gear is covered with the cover side wall in the first direction.

4. The layer transferring device according to claim 1, wherein the multilayer film comprises:

a supporting layer making contact with the heat roller at the first position in the state where the film cartridge is attached to the main casing and the cover is at the closed position; and a supported layer comprising a transfer layer for being transferred onto a sheet, the supported layer making contact with the pressure roller in the state where the film cartridge is attached to the main casing and the cover is at the closed position.

5. The layer transferring device according to claim 4, further comprising a sheet discharging roller provided at the cover and configured to discharge the sheet passed through the portion between the pressure roller and the heat roller to an outside of the main casing, wherein a driving force from the motor is transmitted to both the pressure roller and the sheet discharging roller through the second transmission gear.

6. The layer transferring device according to claim 5, wherein the sheet discharging roller is positioned opposite to the pivot axis of the cover with respect to the pressure roller.

7. The layer transferring device according to claim 5, wherein the number of gears for transmitting a driving force from the motor to the pressure roller is smaller than the number of gears for transmitting a driving force from the motor to the sheet discharging roller.

8. The layer transferring device according to claim 5, wherein the film cartridge further comprises:

a feed reel around which the multilayer film is wounded; and a take-up reel for taking up the supporting layer of the multilayer film, the layer transferring device further comprising:

a conveying roller extending in the first direction and configured to convey a sheet toward the pressure roller;

a first gear train provided in the main casing and configured to receive a driving force from the motor, the first gear train comprising the first transmission gear;

a second gear train provided at the cover and configured to transmit a driving force to the pressure roller, the second gear train comprising the second transmission gear and a clutch;

a third gear train provided at the cover and connected to the second gear train, the third gear train comprising a first conveying roller gear coupled to one end portion in the first direction of the conveying roller and rotatable together with the conveying roller;

a fourth gear train provided in the main casing and connected to the first gear train, the fourth gear train being configured to transmit a driving force from the first gear train to the take-up reel; and a fifth gear train provided at the cover and configured to transmit a driving force to the sheet discharging roller, the fifth gear train comprising a second conveying roller gear coupled to another end portion in the first direction of the conveying roller and rotatable together with the conveying roller.

9. The layer transferring device according to claim 8, wherein the clutch is switchable between a transmission state where a driving force is transmitted from second gear train to the pressure roller and an interruption state where transmission of the driving force to the pressure roller is interrupted.

10. The layer transferring device according to claim 8, wherein the fourth gear train comprises a clutch switchable between a transmission state where a driving force is transmitted from fourth gear train to the take-up reel and an interruption state where transmission of the driving force to the take-up reel is interrupted.

* * * * *